US012595670B2

(12) United States Patent
Xie et al.

(10) Patent No.: US 12,595,670 B2
(45) **Date of Patent: *Apr. 7, 2026**

(54) BOOM AND WORKING EQUIPMENT

(71) Applicant: SANY AUTOMOBILE MANUFACTURING CO., LTD., Changsha (CN)

(72) Inventors: Shihui Xie, Changsha (CN); Xi Guo, Changsha (CN); Jiangbo Li, Changsha (CN)

(73) Assignee: SANY AUTOMOBILE MANUFACTURING CO., LTD., Changsha (CN)

( * ) Notice: Subject to any disclaimer, the term of this patent is extended or adjusted under 35 U.S.C. 154(b) by 843 days.

This patent is subject to a terminal disclaimer.

(21) Appl. No.: 17/909,930

(22) PCT Filed: Aug. 28, 2020

(86) PCT No.: PCT/CN2020/112051

§ 371 (c)(1),
(2) Date: Sep. 7, 2022

(87) PCT Pub. No.: WO2021/179546

PCT Pub. Date: Sep. 16, 2021

(65) Prior Publication Data

US 2024/0200346 A1 Jun. 20, 2024

(30) Foreign Application Priority Data

Mar. 10, 2020 (CN) ..... 202010162108.6

(51) Int. Cl.
*E04G 21/04* (2006.01)

(52) U.S. Cl.
CPC ..... *E04G 21/0445* (2013.01); *Y10T 137/8807* (2015.04)

(58) Field of Classification Search
CPC ..... B66C 23/66; B66C 23/70; E04G 21/0418; E04G 21/0427; E04G 21/0436;
(Continued)

(56) References Cited

U.S. PATENT DOCUMENTS 790,478 A * 5/1905 Byron ..... B66C 23/66 212/347
4,216,895 A * 8/1980 Holmes ..... B66C 23/42 228/178

(Continued)

FOREIGN PATENT DOCUMENTS

CN 101666162 A 3/2010
CN 202248920 U 5/2012

(Continued)

OTHER PUBLICATIONS

CN 202010162108.6 first office action dated Oct. 26, 2023.

(Continued)

*Primary Examiner* — Kenneth Rinehart
*Assistant Examiner* — Jonathan J Waddy
(74) *Attorney, Agent, or Firm* — IPro, PLLC

(57) ABSTRACT

The present disclosure provides a boom comprising a frame structure, wherein the boom comprises: a top plate; a bottom plate, wherein the bottom plate and the top plate are oppositely disposed at an interval; a first side plate; and a second side plate, wherein the second side plate and the first side plate are oppositely disposed at an interval, wherein a first side of the top plate is provided with a first bending portion, and at least a portion of the first bending portion and a first end of the first side plate are attached and spliced to each other, a second side of the top plate opposite to the first bending portion is provided with a second bending portion, at least a portion of the second bending portion and a first end of the second side plate are attached and spliced to each (Continued)

other, and a first side of the bottom plate is provided with a third bending portion, at least a portion of the third bending portion and a second end of the first side plate are attached and spliced to each other, a second side of the bottom plate opposite to the third bending portion is provided with a fourth bending portion, at least a portion of the fourth bending portion and a second end of the second side plate are attached and spliced to each other, and define the frame structure. The present disclosure makes the boom more suitable for mass production by splicing out the boom, and the change cost is low compared to the integrally formed mold.

17 Claims, 10 Drawing Sheets

(58) Field of Classification Search
CPC ..... E04G 21/0445; E04G 21/0454; E04G 21/0463; Y10T 137/8807
USPC ..... 137/615
See application file for complete search history.

(56) References Cited

U.S. PATENT DOCUMENTS 5,245,770 A * 9/1993 Ko ..... E02F 3/38 52/309.9
6,481,587 B2 * 11/2002 Higgins ..... B66C 23/705 52/118
6,719,009 B1 * 4/2004 Bissen ..... E04G 21/0436 138/140
6,755,212 B1 * 6/2004 Anderson ..... F16L 57/06 428/36.1
6,786,233 B1 9/2004 Anderson et al.
2002/0117219 A1 * 8/2002 Anderson ..... F16L 3/015 137/615
2003/0118432 A1 * 6/2003 Lee ..... B66C 23/64 414/722
2003/0215319 A1 * 11/2003 Nurse ..... B66C 23/701 414/685
2004/0161326 A1 * 8/2004 Yamaguchi ..... E02F 3/38 414/722
2006/0251503 A1 * 11/2006 Janes ..... E02F 3/38 414/687
2010/0230371 A1 * 9/2010 Pirri ..... E04G 21/0436 212/347
2013/0020274 A1 * 1/2013 Munuswamy ..... B66C 23/80 212/347
2013/0333829 A1 * 12/2013 Pirri ..... E04G 21/0445 156/173
2019/0316368 A1 * 10/2019 Akkoc ..... B66C 23/64
2020/0080325 A1 * 3/2020 Häfner ..... E04G 21/0436
2020/0370314 A1 * 11/2020 Müller ..... E04G 21/0445

FOREIGN PATENT DOCUMENTS

CN 102493651 A 6/2012
CN 102535857 A 7/2012
CN 202645013 U 1/2013
CN 203113791 U 8/2013
CN 103410326 A 11/2013
CN 203947782 U 11/2014
CN 204001765 U 12/2014
CN 106499187 A 3/2017
CN 207554068 U 6/2018
CN 207554069 U 6/2018
CN 111173287 A 5/2020
CN 111335638 A 6/2020
CN 212154170 U 12/2020
DE 2317595 A1 10/1974
DE 202010014103 U1 1/2012
DE 102013225228 A1 6/2015
EP 1361189 A1 11/2003
EP 1387012 A2 2/2004
EP 3224430 B1 9/2018
WO 2012156807 A1 11/2012
WO 2013185446 A1 12/2013

OTHER PUBLICATIONS

CN 202010162108.6 second office action dated Mar. 6, 2024.
EP 20923993.8 extended European search report dated Apr. 9, 2024.

* cited by examiner

BOOM AND WORKING EQUIPMENT

This application claims priority to Chinese Patent Application No. 202010162108.6 filed with China National Intellectual Property Administration on Mar. 10, 2020 and entitled "BOOM AND WORKING EQUIPMENT", the entire contents of which are herein incorporated by reference.

FIELD

The present disclosure relates to the technical field of boom working equipment, in particular, to boom and working equipment.

BACKGROUND

At present, in the working equipment, such as on the concrete pump truck, the concrete is usually transported by the boom. Most of the booms are mainly steel structures, but the booms of high-strength steel structures are too heavy. However, most of the lightweight booms are made by integral molding of molds; resulting in more complicated molds, high cost, and too much investment in pre-process verification. In addition, for the boom made by integral molding of the mold, if the structure of the boom is optimized, the mold needs to be readjusted, which is not conducive to mass production.

SUMMARY

The present disclosure aims to solve at least one of the technical problems existing in the prior art or related art.

To this end, a first aspect of the present disclosure provides a boom.

A second aspect of the present disclosure provides a working equipment.

In view of this, the first aspect of the present disclosure provides a boom comprising a frame structure, wherein the boom comprises a top plate; a bottom plate, wherein the bottom plate and the top plate are oppositely disposed at an interval; a first side plate; and a second side plate, wherein the second side plate and the first side plate are oppositely disposed at an interval, wherein a first side of the top plate is provided with a first bending portion, and at least a portion of the first bending portion and a first end of the first side plate are attached and spliced to each other, a second side of the top plate opposite to the first bending portion is provided with a second bending portion, at least a portion of the second bending portion and a first end of the second side plate are attached and spliced to each other, and a first side of the bottom plate is provided with a third bending portion, at least a portion of the third bending portion and a second end of the first side plate are attached and spliced to each other, a second side of the bottom plate opposite to the third bending portion is provided with a fourth bending portion, at least a portion of the fourth bending portion and a second end of the second side plate are attached and spliced to each other, and define the frame structure.

The top plate, the bottom plate, the first side plate and the second side plate are all plate body structures, which can give full play to the compression resistance and the tensile strength properties of the bottom plate and the top plate. Wherein the corresponding mounting holes are machined on the first side plate and the second side plate according to the use requirements of the boom, to install the relevant parts. The shape of the bottom plate is adapted to one side of the first side plate away from the top plate and one side of the second side plate away from the top plate. Since the body of the top plate is a flat plate structure, the first bending portion and the second bending portion respectively form an included angle with the body of the first side plate and the body of the second side plate, and the included angle is 90°. Therefore, the first bending portion and the second bending portion can attach to the first end of the first side plate and the first end of the second side plate, respectively. In order to attach the third bending portion and the fourth bending portion to the second end of the first side plate and the second end of the second side plate, respectively, to realize the firmness of the connection structure, the third bending portion and the fourth bending portion can match the shape of the bottom plate. The top plate, the bottom plate, the first side plate and the second side plate are spliced together to assemble the frame structure of boom. Compared with the boom with an integral structure, the cost of making the mold of the boom is reduced, and the production efficiency of the boom is improved at the same time. In addition, the splicing structure is more conducive to realizing the interconnection between different materials.

According to the above-mentioned boom of the present disclosure, it may also have the following additional technical features.

In the embodiment, the first bending portion and the second bending portion are respectively integrally formed with the top plate, and both face the bottom plate, the third bending portion and the fourth bending portion are respectively integrally formed with the bottom plate, and both face the top plate.

The first bending portion and the second bending portion are integrally formed with the top plate, respectively, and the third bending portion and the fourth bending portion are integrally formed with the bottom plate, respectively. The forming process of the top plate and the bottom plate is simplified, the forming efficiency of bottom plate and the top plate is improved, and the forming efficiency of the boom is further improved.

Since the first side plate and the second side plate are respectively straight plates, the first end of the first side plate and the first bending portion are spliced to each other, and the second end of the first side plate and the third bending portion are spliced to each other. Similarly, the first end of the second side plate and the second bending portion are spliced to each other, and the second end of the second side plate and the fourth bending portion are spliced to each other, so that the top plate, the bottom plate, the first side plate and the second side plate are spliced to form the boom. The structure of the boom spliced in this way is more stable and firm, which can improve the structural strength of the boom. The first end of the first side plate and the first bending portion are attached to each other, and the second end of the first side plate and the third bending portion are attached to each other; the first end of the second side plate and the second bending portion are attached to each other; the second end of the second side plate and the fourth bending portion are attached to each other. The first end of the first side plate is attached to the inner or outer side of the first bending portion, and the first end of the second side plate is attached to the inner or outer side of the second bending portion. Similarly, the second end of the first side plate is attached to the inner or outer side of the third bending portion; the second end of the second side plate is attached to the inner or outer side of the fourth bending portion. Then the boom is spliced out by welding, riveting and/or fastener connection, etc., which can further increase the structural strength of the boom.

In one possible design, the first bending portion and the second bending portion are respectively connected with the first end of the first side plate and the first end of the second side plate in a rivet bonding connection, the third bending portion and the fourth bending portion are respectively connected with the second end of the first side plate and the second end of the second side plate in a rivet bonding connection.

The first bending portion and the third bending portion are respectively spliced with the opposite ends of the first side plate, and the second bending portion and the fourth bending portion are respectively spliced with the opposite ends of the second side plate. Their splicing structure is a mixed connection method of gluing and riveting. It can play the role of fast connection and can improve the splicing speed of boom.

In one possible design, the boom further comprises a first clamping slot, provided on an end surface of the first bending portion facing the bottom plate; a second clamping slot, provided on an end surface of the second bending portion facing the bottom plate; a third clamping slot, provided on an end surface of the third bending portion facing the top plate; and a fourth clamping slot, provided on an end surface of the fourth bending portion facing the top plate, wherein, opposite ends of the first side plate are respectively clamped with the first clamping slot and the third clamping slot, opposite ends of the second side plate are respectively clamped with the second clamping slot and the fourth clamping slot.

At least a portion of one side of the first side plate is clamped in the first clamping slot, and at least a portion of another side of the first side plate is clamped in the third clamping slot. Similarly, at least a portion of one side of the second side plate is clamped in the second clamping slot, and at least a portion of another side of the second side plate is clamped in the fourth clamping slot. Therefore, taking the installation of the first side plate as an example, the first clamping slot and the third clamping slot can play a limiting role on both ends of the first side plate, to help define the position of the first side plate. Then, the first side plate is fixed by welding, riveting, fastener connection, etc. It can be seen that the first clamping slot and the third clamping slot can not only make the installation of the first side plate more convenient, but also make the connection structure between the first side plate and the top plate and the bottom plate more stable. Similarly, the installation of the second side plate is the same; therefore, the integral structural strength of the boom can be further increased.

In one possible design, the boom further comprises a middle body; a first connecting portion, provided at one end the middle body in a length direction and protruding out of the middle body; a second connecting portion, provided at the other end of the middle body in a length direction, wherein a thickness of the middle body gradually decreases from the first connecting portion to the second connecting portion, a thickness of the second connecting portion is equal to a thickness of one end of the middle body away from the first connecting portion.

The length of the boom is longer, wherein the first connecting portion, the second connecting portion and the middle body are bounded by the top plate, the bottom plate, the first side plate and the second side plate to form a frame structure. One end of the first side plate and the second side plate of the middle body away from the top plate is provided with an oil cylinder mounting seat. The oil cylinder mounting seat comprises two cylinder mounting holes on the first side plate and the second side, and the two cylinder mounting holes are set opposite to each other to install the cylinder. When the boom is used in the boom system, the head and tail of multiple booms are hinged to each other, and the extension and folding of the boom system are realized through the oil cylinder. Wherein, the first connecting portion and the second connecting portion are used as the hinged connection ends to realize the hinged connection between the two adjacent booms or to realize the connection with the external components and the working equipment respectively. When the first connecting portion is not used as a hinged end, but needs to be connected to pre-working equipment or an external component, there is no need to carry a large weight, and there is no need to set up an oil cylinder mounting seat on the boom used as a terminal. Therefore, in order to further reduce the weight of the boom, the thickness of the first connecting portion of the boom used in the boom system at the terminal can be smaller, while the thickness of the first connecting portion of the boom used as the hinged end is relatively larger.

In addition, the thickness of the middle body gradually decreases from the first connecting portion to the second connecting portion, which can save the usage of the first side plate and the second side plate, and can further reduce the weight. The thickness of the second connecting portion is equal to one end of the middle body away from the first connecting portion, the structure is simple, the production is convenient, and the production process can be simplified. Correspondingly, on the boom where the oil cylinder mounting seat needs to be set, the bottom plate can be divided into two parts. On the boom where the oil cylinder mounting seat does not need to be set, the bottom plate can extend from the first connecting portion to the second connecting portion.

In one possible design, the first side plate and the second side plate both comprises a first plate body, provided at one end of the first side plate or one end of the second side plate in a length direction, a second plate body, disposed with the first plate body side by side; and a third plate body, provided at the other end of the first side plate or the other end of the second side plate in a length direction, wherein thicknesses of the first plate body and the third plate body are respectively greater than a thickness of the second plate body, the second plate body is respectively connected with the first plate body and the third plate body on opposite sides in a length direction by friction welding, to splice out the first side plate or the second side plate.

The first side plate or the second side plate of the boom as the middle hinged end is welded by the first plate body, the second plate body and the third plate body by friction stir welding. Since the first plate body is located at the end portion of the first end of the first side plate or the second side plate, that is, the first plate body is located at the first connecting portion. Therefore, the thickness of the first plate body is greater than that of the second plate body, so as to enhance the structural strength and make the first connecting portion play a better connection role. The thickness of the third plate body is greater than that of the second plate body, so that the second connecting portion can play a better connection role. The inner surface of the first plate body, the inner surface of the second plate body and the inner surface of the third plate body are located in the same plane, that is, the outer surface of the first plate body and the outer surface of the third plate body both protrude from the outer surface of the second plate body. It is convenient to install the axle sleeve on the first connecting portion and the second connecting portion.

which makes the connection between the two adjacent booms more convenient. Friction welding is a method of using the heat generated by the mutual movement and friction of the end surfaces of the work piece to make the end portion reach a thermoplastic state, and then quickly upsetting to complete the welding. Friction stir welding is a kind of friction welding, and friction stir welding also uses friction heat and plastic deformation heat as welding heat sources. The difference between it and ordinary friction welding is that the welding process of friction stir welding is that a stirring needle of a cylinder or other shape (such as a threaded cylinder) is inserted into the joint of the work piece, and the high-speed rotation of the welding head makes it rub against the welding work piece material, so that the temperature of the material at the connecting portion increases and softens. The first plate body, the second plate body and the third plate body are connected by friction stir welding, which can ensure the integral structural strength of the first side plate or the second side plate.

In one possible design, the boom further comprises a first rib plate, provided on a surface of the first side plate facing the second side plate, and the first rib plate being located between the first bending portion and the third bending portion; and a second rib plate, provided on a surface of the second side plate facing the first side plate, and the second rib plate being located between the second bending portion and the fourth bending portion.

The first rib plate and the first side plate are arranged in an integrated structure, and the second rib plate and the second side plate are also arranged in an integrated structure, which can not only enhance the structural strength of the first side plate and the second side plate, but also simplify the structure and simplify the processing technology.

In one possible design, the boom further comprises a support member, arranged in the frame structure, wherein the support member comprises a support frame, the support frame comprises four edge frames and four inner corners, and the four edge frames are adapted to abut with the top plate, the bottom plate, the first side plate and the second side plate respectively; and a support bracket, comprising two mutually intersecting support plates to be supported on the four inner corners of the support frame.

One or more support members can be set in the frame structure of the boom. The support member is supported in the frame structure through the support frame, and the support for the frame structure is further increased through the support bracket, which can increase the integral structural strength of the boom.

In one possible design, the top plate and the bottom plate are carbon fiber plates respectively, the first side plate and the second side plate are aluminum alloy plates respectively, and the support member is composed of multiple aluminum alloy plates.

Aluminum alloy is selected as the material of the top plate and the bottom plate, and the weight of aluminum alloy is lighter than that of steel plate. Therefore, the boom assembled by splicing the carbon fiber plate and the aluminum alloy plate not only reduces the weight, but also ensures the compression resistance performance of the boom, and reduces the raw material cost compared with the boom made of pure carbon fiber material. In addition, the combination of aluminum alloy and carbon fiber sheet also greatly reduces the cost of the mold for the boom, and at the same time, compared with the carbon fiber boom made as a whole, the molding efficiency of the boom is also improved.

The second aspect of the present disclosure provides a working equipment, comprising a chassis; and a boom system, provided on the chassis, wherein, the boom system comprises a plurality of booms according to any one of the first aspects, and two adjacent booms are hinged to each other.

The working equipment provided by the present disclosure comprises a boom as designed in any one of the first aspects, and therefore it has all the beneficial effects of the boom as designed in any one of the first aspects, and will not be repeated here.

Additional aspects and advantages of the present disclosure will become apparent in the following description or will be learned by practice of the present disclosure.

Figure 1:
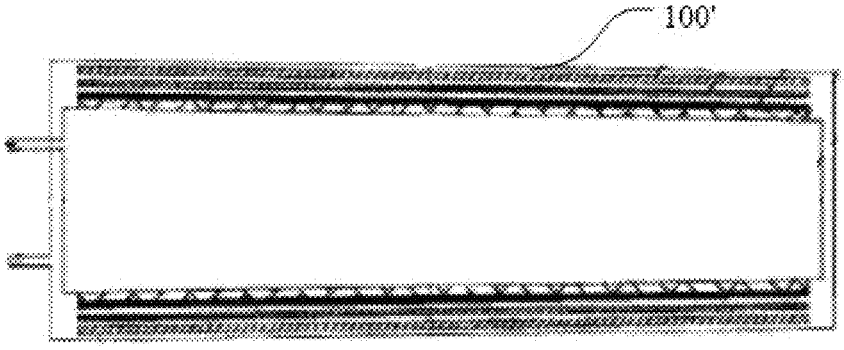
FIG. 1 (Prior Art)
FIG. 1 is a schematic structural diagram of a boom in the related art.
Figure 2:
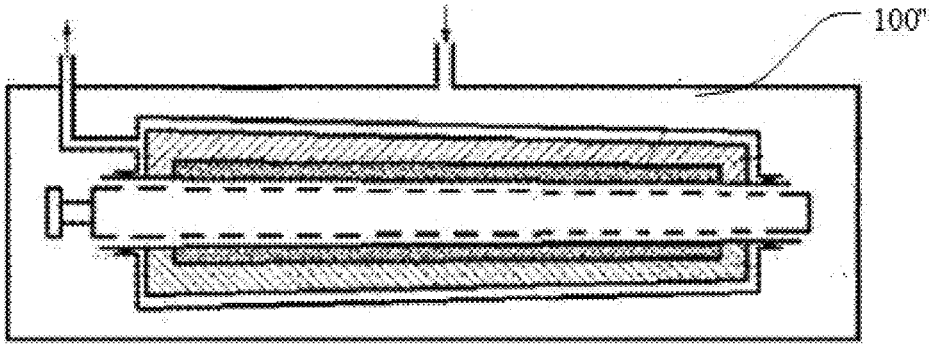
FIG. 2 (Prior Art)
FIG. 2 is a schematic structural diagram of a boom in another related art.

The corresponding relationship between the reference signs and component names in FIGS. 1 and 2 is as follows:

100' integral carbon fiber boom, 100" carbon fiber boom.

The corresponding relationship between the reference signs and component names in FIGS. 3 to 13 is as follows:

100 boom, 102 middle body, 104 first connecting portion, 106 second connecting portion, 108 fixing part, 110 top plate, 112 first bending portion, 114 second bending portion, 116 first clamping slot, 118 second clamping slot, 120 bottom plate, 122 third bending portion, 124 fourth bending portion, 126 third clamping slot, 128 fourth clamping slot, 130 first side plate, 132 first rib plate, 140 second side plate, 142 second rib plate, 150 axle sleeve, 160 first plate body, 162 second plate body, 164 third plate body, 170 first steel guard plate, 172 second steel guard plate, 180 oil cylinder mounting seat, 190 support member, 192 support frame, 194 support bracket.

DETAILED DESCRIPTION OF THE DISCLOSURE

In order to understand the above-mentioned objects, features and advantages of the present disclosure more clearly, the present disclosure will be described in further detail with reference to the accompanying drawings and detailed description. It should be noted that the embodiments and features in the embodiments of the present disclosure may be combined with one another without conflicts.

In the following description, numerous specific details are set forth in order to provide a thorough understanding of the present disclosure, but the present disclosure may be practiced otherwise than as described herein, and therefore, the protection scope of the present disclosure is not limited to the exemplary embodiments disclosed below.

In a related art, most of the booms of concrete pump trucks are mainly steel structures, but there is little room for the development of high-strength steel structures. The research on lightweight boom is mainly based on carbon fiber composite materials and aluminum alloys, but the current research on both is mainly based on the integral molding of a single material, such as the boom of pure carbon fiber composite material, the boom of carbon fiber foam sandwich composite material and the boom 100' of integral carbon fiber as shown in FIG. 1. The production method of the boom of carbon fiber composite material comprises inflating a retractable air bag to form an air bag with a first state, and laying the carbon fiber prepreg on its outer surface to obtain the component, put it into the box mold and inflate the airbag, and then compress and shape the carbon fiber prepreg to obtain the second transition component. The second transition component is heated and solidified, and after solidification, the carbon fiber boom is obtained by cooling and demoulding. The cost of this integral carbon fiber boom 100' is relatively expensive, resulting in a higher cost of the boom and lower cost performance. Moreover, the mold used for the integrally formed boom model is complex and expensive, and the investment in the pre-process verification is too large. Each structural optimization requires re-adjustment of the mold, which is also extremely disadvantageous for the cost of later mass production.

In another related art, as shown in FIG. 2, a carbon fiber boom 100" for a concrete pump truck is provided with an outer mold, and the outer mold is composed of an upper mold and a lower mold and has a hollow structure. The carbon fiber prepreg for making carbon fiber boom 100" is spread on the inner surfaces of the upper and lower molds. The mechanical properties and size of the composite material boom have extremely high requirements on mold tooling and process, which will lead to process instability. Thereby, problems such as internal defects occur, and there are problems with the connection strength of steel structural parts, aluminum structural parts and carbon fiber composite structural parts.

The technical solutions of some embodiments of the present disclosure are described below with reference to FIGS. 3 to 13.

Embodiment 1

As shown in FIGS. 3 to 6, this embodiment provides a boom 100 comprising a frame structure, wherein the boom 100 comprises: a top plate 110; a bottom plate 120, wherein the bottom plate 120 and the top plate 110 are oppositely disposed at an interval; a first side plate 130; and a second side plate 140, wherein the second side plate 140 and the first side plate 130 are oppositely disposed at an interval. A first side of the top plate 110 is provided with a first bending portion 112, and at least a portion of the first bending portion 112 and a first end of the first side plate 130 are attached and spliced to each other, a second side of the top plate 110 opposite to the first bending portion 112 is provided with a second bending portion 114, at least a portion of the second bending portion 114 and a first end of the second side plate 140 are attached and spliced to each other, and a first side of the bottom plate 120 is provided with a third bending portion 122, at least a portion of the third bending portion 122 and a second end of the first side plate 130 are attached and spliced to each other, a second side of the bottom plate 120 opposite to the third bending portion 122 is provided with a fourth bending portion 124, at least a portion of the fourth bending portion 124 and a second end of the second side plate 140 are attached and spliced to each other, and define the frame structure.

In this embodiment, the top plate 110, the bottom plate 120, the first side plate 130 and the second side plate 140 are all plate body structures, the top plate 110 and the bottom plate 120 with the same thickness can give full play to the compression resistance and the tensile strength properties of the bottom plate 120 and the top plate 110. Wherein the corresponding mounting holes are machined on the first side plate 130 and the second side plate 140 according to the use requirements of the boom 100, to install the relevant parts. For example, the mounting holes are used for mounting the axle sleeve 150, the oil cylinder, and the like. The shape of the bottom plate 120 is adapted to one side of the first side plate 130 away from the top plate 110 and one side of the second side plate 140 away from the top plate 110. Since the body of the top plate 110 is a flat plate structure, the first bending portion 112 and the second bending portion 114 respectively form an included angle with the body of the first side plate 130 and the body of the second side plate 140, and the included angle is 90°. Therefore, the first bending portion 112 and the second bending portion 114 can attach to the first end of the first side plate 130 and the first end of the second side plate 140, respectively. In order to attach the third bending portion 122 and the fourth bending portion 124 to the second end of the first side plate 130 and the second end of the second side plate 140, respectively, to realize the firmness of the connection structure, the third bending portion 122 and the fourth bending portion 124 can match the shape of the bottom plate 120. The top plate 110, the bottom plate 120, the first side plate 130 and the second side plate 140 are spliced together to assemble the frame structure of boom 100. Compared with the boom 100 with an integral structure, the cost of making the mold of the boom 100 is reduced, and the production efficiency of the boom 100 is improved at the same time. In addition, the splicing structure is more conducive to realizing the interconnection between different materials. For example, when the materials of the first side plate 130 and the second side plate 140 are different from that of the bottom plate 120 or the top plate 110, the frame structure of the boom 100 can be easily assembled by splicing together the structure group. Thereby, the connection cost of the interconnection can be reduced and the molding efficiency of the boom 100 can be improved.

In addition, in order to further increase the integral structural strength of the boom 100, the first side plate 130 and the second side plate 140 are both straight plates. The opposite sides of the top plate 110 are spliced with the first end of the first side plate 130 and the first end of the second side plate 140 respectively. The opposite sides of the bottom plate 120 are spliced with the second end of the first side plate 130 and the second end of the second side plate 140 respectively, which is simpler during splicing, and facilitates the installation of the fixing part 108, so that the spliced frame structure is more stable. Wherein, the fixing part 108 may be a U-shaped fixing piece, so that at least a portion of the top plate 110 is clamped in the groove of the fixing piece, so that a fastener such as a screw can be used between the middle portion of the fixing piece and the top plate 110 to further strengthen. And the two sides of the fixing piece can be fixed with the first side plate 130 and the second side plate 140 by fasteners such as screws, so as to further improve the integral structural stability of the boom 100.

The top plate 110 and the bottom plate 120 are bonded and mechanically connected with the first side plate 130 and the second side plate 140, respectively. The first side plate 130 and the top plate 110 and the bottom plate 120, as well as the second side plate 140 and the top plate 110 and the bottom plate 120, are connected by bonding and mechanical connection. Wherein, the mechanical connection is fastener connection or riveting, and the fastener connection can be screw connection, bolt connection, etc. Specifically, the opposite sides of the top plate 110 are respectively bonded with the first end of the first side plate 130 and the first end of the second side plate 140, and then connected by fasteners. Similarly, the opposite sides of the bottom plate 120 are respectively bonded to the second end of the first side plate 130 and the second end of the second side plate 140, and then connected by fasteners.

Embodiment 2

As shown in FIGS. 5 to 8, this embodiment provides a boom 100. In addition to the technical features of the above-mentioned embodiments, this embodiment also comprises the following technical features.

The first bending portion 112 and the second bending portion 114 are respectively integrally formed with the top plate 110, and both face the bottom plate 120, the third bending portion 122 and the fourth bending portion 124 are respectively integrally formed with the bottom plate 120, and both face the top plate 110.

In this embodiment, the first bending portion 112 and the second bending portion 114 are integrally formed with the top plate 110, respectively, and the third bending portion 122 and the fourth bending portion 124 are integrally formed with the bottom plate 120, respectively. The forming process of the top plate and the bottom plate is simplified, the forming efficiency of bottom plate and the top plate is improved, and the forming efficiency of the boom is further improved. Since the first side plate 130 and the second side plate 140 are respectively straight plates, the first end of the first side plate 130 and the first bending portion 112 are spliced to each other, and the second end of the first side plate 130 and the third bending portion 122 are spliced to each other. Similarly, the first end of the second side plate 140 and the second bending portion 114 are spliced to each other, and the second end of the second side plate 140 and the fourth bending portion 124 are spliced to each other, so that the top plate 110, the bottom plate 120, the first side plate 130 and the second side plate 140 are spliced to form the boom 100. The structure of the boom 100 spliced in this way is more stable and firm, which can improve the structural strength of the boom 100.

In this embodiment, specifically, the first end of the first side plate 130 is attached to the first bending portion 112, and the first end of the second side plate 140 is attached to the second bending portion 114. The second end of the first side plate 130 is attached to the third bending portion 122, and the second end of the second side plate 140 is attached to the fourth bending portion 124. The first bending portion 112 and the second bending portion 114 make the cross section of the top plate 110 U-shaped, so that the first end of the first side plate 130 can be attached to the inner side of the first bending portion 112, and the first end of the second side plate 140 can be attached to the inner side of the second bending portion 114. Similarly, the third bending portion 122 and the fourth bending portion 124 make the cross section of the bottom plate 120 U-shaped. The second end of the first side plate 130 is attached to the inner side of the third bending portion 122, and the second end of the second side plate 140 is attached to the inner side of the fourth bending portion 124. The boom 100 is then spliced out by bonding, welding, riveting and/or fastener connections, etc., which can further increase the structural strength of the boom 100.

Figure 8:
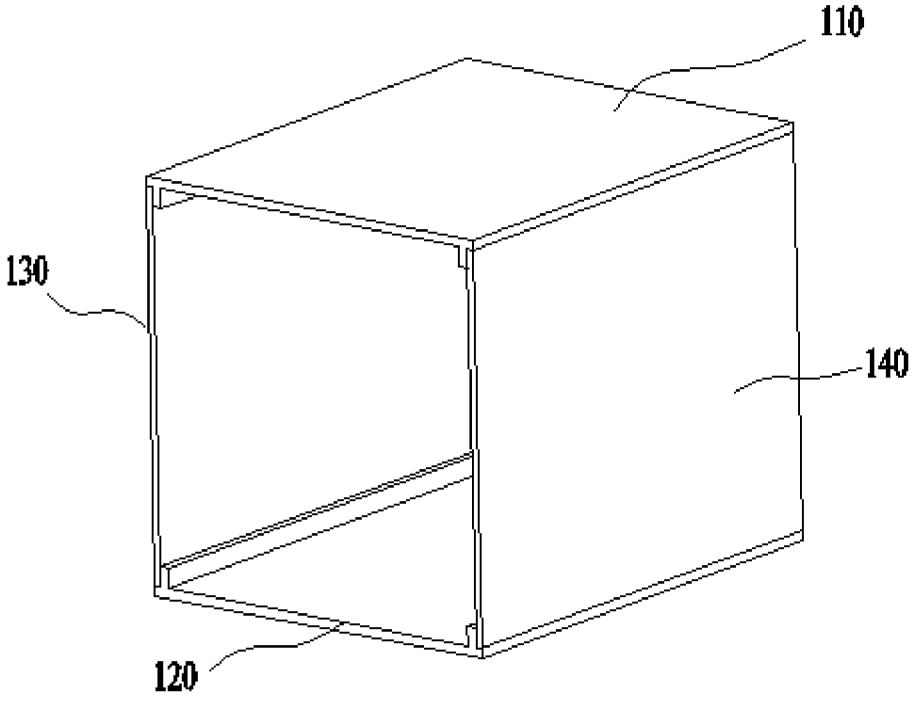
FIG. 8 is a three-dimensional schematic structural diagram of a partial frame structure of a boom according to other embodiments of the present disclosure.

In addition, as shown in FIG. 8, the first bending portion 112 and the second bending portion 114 make the cross section of the top plate 110 T-shaped. Similarly, the third bending portion 122 and the fourth bending portion 124 make the cross section of the bottom plate 120 T-shaped. Taking the first bending portion 112 as an example, there is a gap between the outer side surface of the first bending portion 112 and the edge of the top plate body, the first end of the first side plate 130 is located in the gap and is attached to the outer side of the first bending portion 112, which is more convenient for the connection and fixation of the first side plate 130 and the second side plate 140. In addition, in order to facilitate the installation of the fixing part 108, the first side plate 130 will not protrude from the edge of the top plate 110. Similarly, the second bending portion 114, the third bending portion 122 and the fourth bending portion 124 are also arranged.

In this embodiment, the first bending portion 112 and the second bending portion 114 are respectively provided integrally with the top plate 110, and the first bending portion 112 and the second bending portion 114 respectively form an included angle with the body of the top plate 110, and the included angle is 90°. Similarly, the third bending portion 122 and the fourth bending portion 124 are respectively provided integrally with the bottom plate 120, and the third bending portion 122 and the fourth bending portion 124 respectively form an included angle with the body of the bottom plate 120, and the included angle is 90°.

Embodiment 3

As shown in FIGS. 5 to 8, this embodiment provides a boom 100. In addition to the technical features of the above-mentioned embodiments, this embodiment also comprises the following technical features.

The first bending portion 112 and the second bending portion 114 are respectively connected with the first end of the first side plate 130 and the first end of the second side plate 140 in a rivet bonding connection, the third bending portion 122 and the fourth bending portion 124 are respectively connected with the second end of the first side plate 130 and the second end of the second side plate 140 in a rivet bonding connection.

In this embodiment, the first bending portion 112 and the third bending portion 122 are respectively spliced with the opposite ends of the first side plate 130, and the second bending portion 114 and the fourth bending portion 124 are respectively spliced with the opposite ends of the second side plate 140. Their splicing structure is a mixed connection method of gluing and riveting. It can play the role of fast connection and can improve the splicing speed of boom 100. In addition, the connection method of the rivet bonding connection can also be, firstly gluing, which can not only play the role of connection, but also can quickly locate; and then riveting is carried out, which can further improve the splicing speed and the splicing quality of the integral boom.

Embodiment 4

Figure 7:
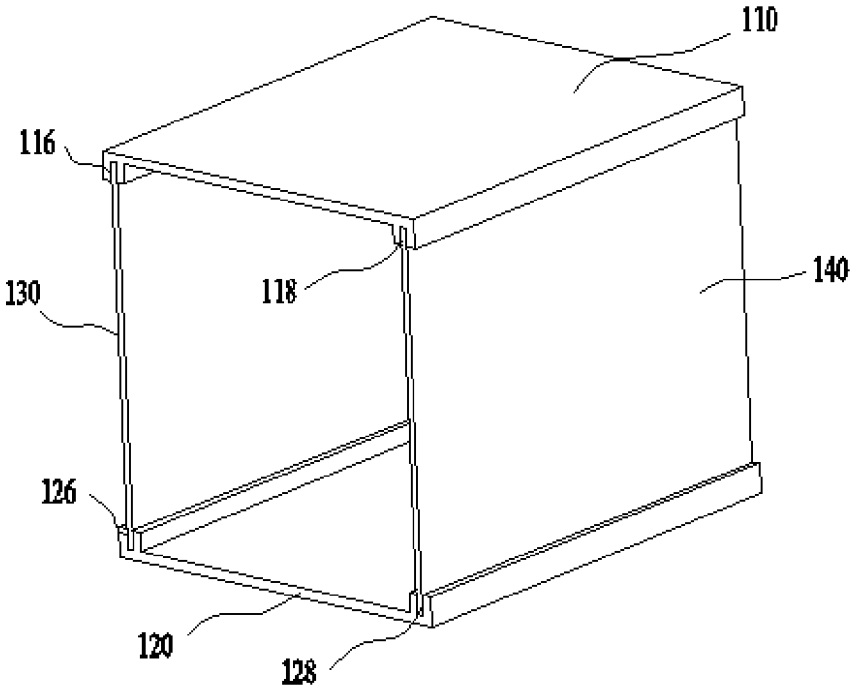
FIG. 7 is a three-dimensional schematic structural diagram of a partial frame structure of a boom of an embodiment of the present disclosure.

As show in FIG. 7, this embodiment provides a boom 100. In addition to the technical features of the above-mentioned embodiments, this embodiment also comprises the following technical features.

The boom 100 also comprises a first clamping slot 116, a second clamping slot 118, a third clamping slot 126 and a fourth clamping slot 128. The first clamping slot 116 is provided on an end surface of the first bending portion 112 facing the bottom plate 120; the second clamping slot 118 is provided on an end surface of the second bending portion 114 facing the bottom plate 120; the third clamping slot 126 is provided on an end surface of the third bending portion 122 facing the top plate 110; and the fourth clamping slot 128 is provided on an end surface of the fourth bending portion 124 facing the top plate 110, wherein, opposite ends of the first side plate 130 are respectively clamped with the first clamping slot 116 and the third clamping slot 126, opposite ends of the second side plate 140 are respectively clamped with the second clamping slot 118 and the fourth clamping slot 128.

In this embodiment, at least a portion of one side of the first side plate 130 is clamped in the first clamping slot 116, and at least a portion of another side of the first side plate 130 is clamped in the third clamping slot 126. Similarly, at least a portion of one side of the second side plate 140 is clamped in the second clamping slot 118, and at least a portion of another side of the second side plate 140 is clamped in the fourth clamping slot 128. Therefore, taking the installation of the first side plate 130 as an example, the first clamping slot 116 and the third clamping slot 126 can play a limiting role on both ends of the first side plate 130, to help define the position of the first side plate 130. Then, the first side plate 130 is fixed by welding, riveting, fastener connection, etc. It can be seen that the first clamping slot 116 and the third clamping slot 126 can not only make the installation of the first side plate 130 more convenient, but also make the connection structure between the first side plate 130 and the top plate 110 and the bottom plate 120 more stable. Similarly, the installation of the second side plate 140 is the same; therefore, the integral structural strength of the boom 100 can be further increased.

Embodiment 5

As shown in FIG. 3, FIG. 4, FIG. 9, FIG. 10, FIG. 11, FIG. 12 and FIG. 13, this embodiment provides a boom 100. In addition to the technical features of the above-mentioned embodiments, this embodiment also comprises the following technical features.

The boom 100 also comprises a middle body 102, a first connecting portion 104 and a second connecting portion 106. The first connecting portion 104 is provided at one end the middle body 102 in a length direction and protruding out of the middle body 102; the second connecting portion 106 is provided at the other end of the middle body in a length direction, wherein a thickness of the middle body 102 gradually decreases from the first connecting portion 104 to the second connecting portion 106, a thickness of the second connecting portion 106 is equal to a thickness of one end of the middle body 102 away from the first connecting portion 104.

In this embodiment, one of the boom 100 located in the boom system needs at least one end to be articulated with the adjacent boom 100. Therefore, each boom 100 in the boom system comprises a first connecting portion 104, a middle body 102 and a second connecting portion 106. There is no doubt that the boom 100 located in the middle of the boom system needs two hinged ends, while the boom 100 located at the terminal may only need one hinged end. Therefore, the specific structures of the multiple booms 100 that make up the boom system are not the same.

Figure 3:
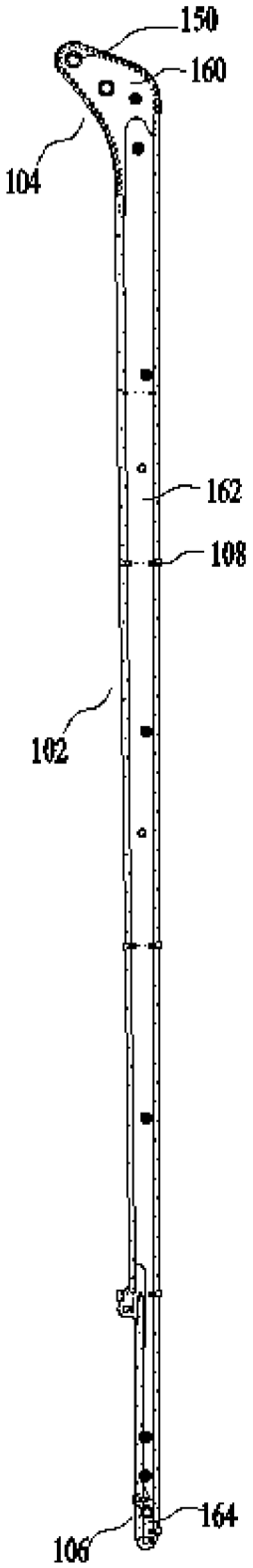
FIG. 3 is a front view schematic structural diagram of a boom according to some embodiments of the present disclosure.
Figure 4:
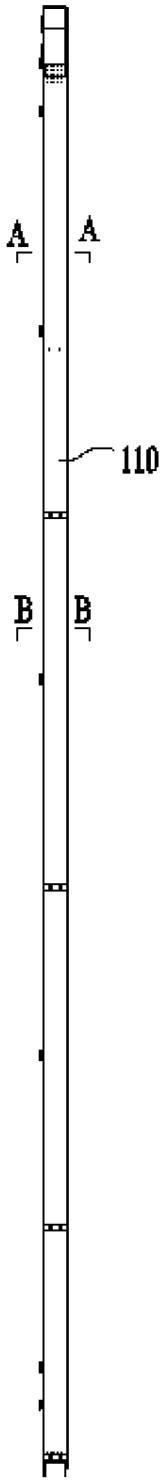
FIG. 4 is a side view schematic structural diagram of a boom according to some embodiments of the present disclosure.

As shown in FIGS. 3 and 4, when both the first connecting portion 104 and the second connecting portion 106 need to be used as hinged ends, that is, the specific structure of the boom 100 located in the middle is that the first side plate 130 and the second side plate 140 respectively extend from the middle body 102 in a direction away from the second connecting portion 106 and in a direction away from the top plate 110 with a lug structure. Therefore, one side of the first side plate 130 and one side of the second side plate 140 located at the first connecting portion 104 away from the top plate 110 are arc-shaped, and the bottom plate 120 located at the first connecting portion 104 is also arc-shaped. Then, the third bending portion 122 and the fourth bending portion 124 located at the first connecting portion 104 are also arc-shaped. The first side plate 130 and the second side plate 140 of the middle body 102 are provided with an oil cylinder mounting seat 180 at one end away from the top plate 110. The oil cylinder mounting seat 180 comprises two cylinder mounting holes provided on the first side plate 130 and the second side plate 140, and the two cylinder mounting holes are arranged opposite to each other for mounting the cylinder. When in the boom system, the head and tail of multiple booms 100 are hinged to each other, and the extension and folding of the boom system are realized through the oil cylinder. Wherein, the first connecting portion 104 and the second connecting portion 106 are used as the hinged connection ends to realize the hinged connection between the two adjacent booms 100 or to realize the connection with the external components and the working equipment respectively. Correspondingly, on the boom 100 where the oil cylinder mounting seat 180 needs to be set, the bottom plate 120 can be divided into two parts, as shown in FIG. 3. On the boom 100 located at the terminal of the boom system without setting the oil cylinder mounting seat 180, as shown in FIG. 7, the bottom plate 120 can extend from the first connecting portion 104 to the second connecting portion 106.

In addition, in order to increase the structural strength of the first connecting portion 104, steel plate reinforcement is also required. For example, a first steel guard plate 170 is provided on top of the first connecting portion 104, and both sides of the first steel guard plate 170 are connected with the first side plate 130 and the second side plate 140, respectively. The bottom of the first connecting portion 104 is provided with a second steel guard plate 172, and the second steel guard plate 172 is connected with the bottom plate 120.

Figure 9:
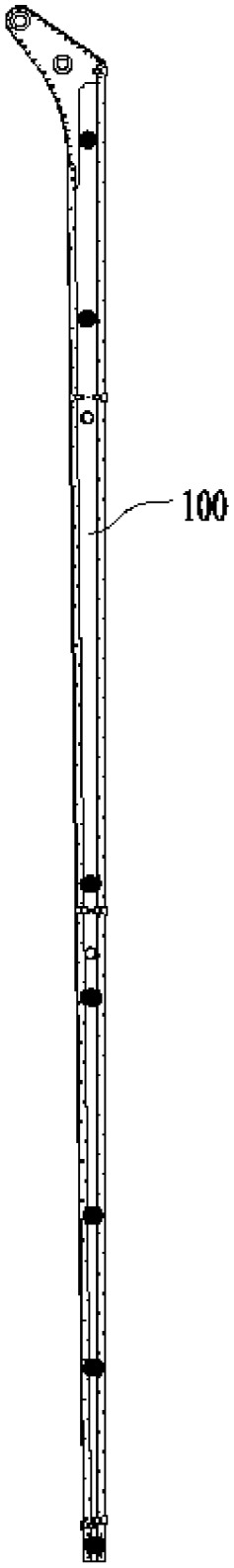
FIG. 9 is a front view schematic structural diagram of a boom located at a terminal position of a boom system according to some embodiments of the present disclosure.
Figure 10:
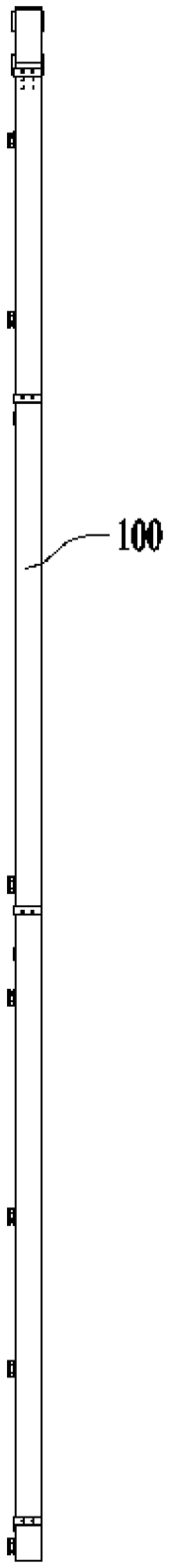
FIG. 10 is a side view schematic structural diagram of a boom located at a terminal position of a boom system according to some embodiments of the present disclosure.
Figure 11:
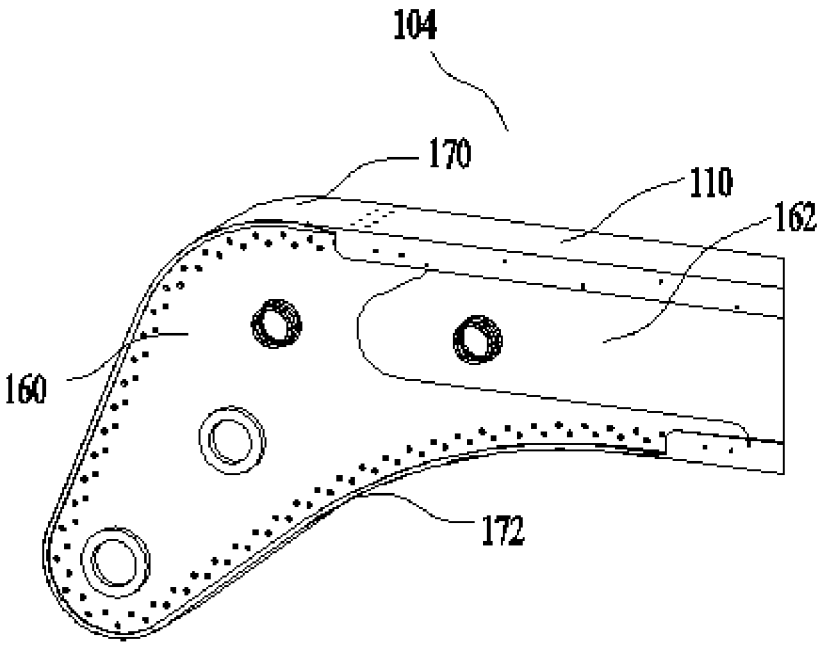
FIG. 11 is a three-dimensional schematic structural diagram of a first connecting portion of a boom according to some embodiments of the present disclosure.
Figure 12:
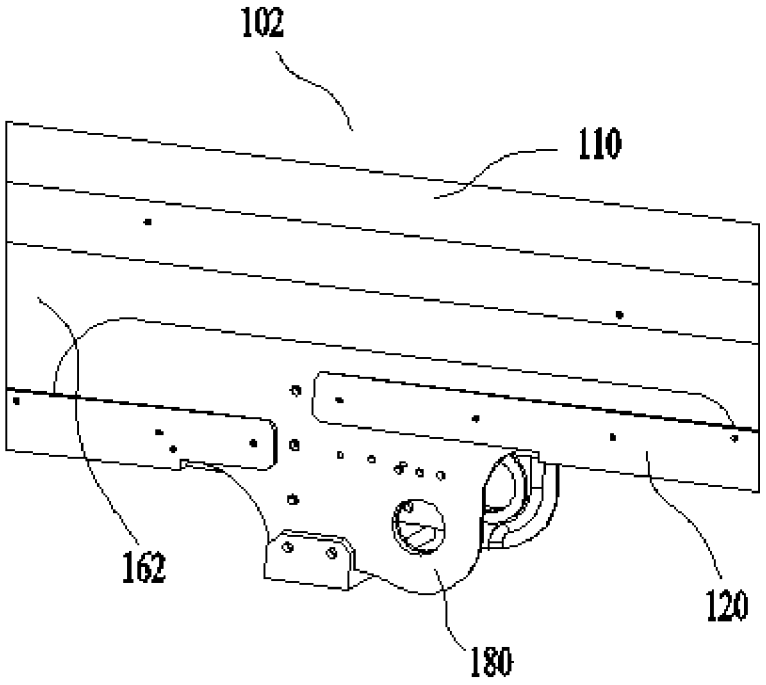
FIG. 12 is a three-dimensional schematic structural diagram of a middle body of a boom according to some embodiments of the present disclosure.
Figure 13:
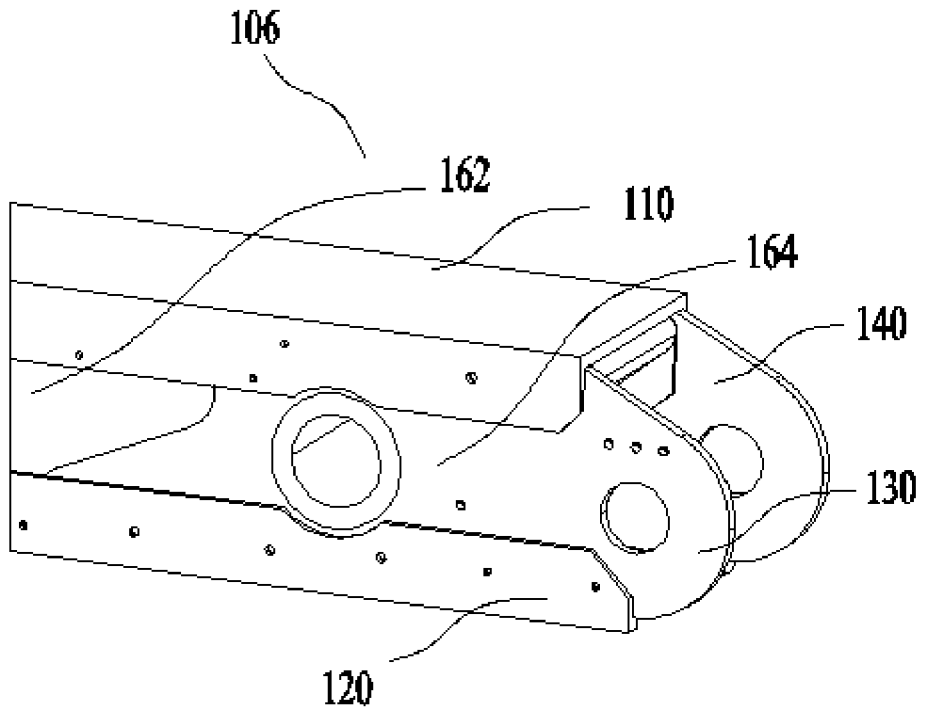
FIG. 13 is a three-dimensional schematic structural diagram of a second connecting portion of a boom according to some embodiments of the present disclosure.

As shown in FIGS. 9 and 10, when the second connecting portion 106 is not used as a hinged end, but needs to be connected with a pre-working equipment or an external component, it does not need to carry a large weight, and there is no need to set the oil cylinder mounting seat 180 on the boom 100 used as a terminal. Therefore, as shown in FIGS. 8 and 9, in order to further reduce the weight of the boom 100, the thickness of the first connecting portion 104 in the boom 100 used in the boom system at the terminal can be made smaller. However, the thickness of the first connecting portion 104 of the boom 100 used as the hinged end is relatively large. In addition, the thickness of the middle body 102 is gradually reduced from the first connecting portion 104 to the second connecting portion 106, which can save the usage of the first side plate 130 and the second side plate 140, and can further reduce the weight. The thickness of the second connecting portion 106 is equal to one end of the middle body 102 away from the first connecting portion 104, the structure is simple, the production is convenient, and the production process can be simplified.

Embodiment 6

As shown in FIG. 3, this embodiment provides a boom 100. In addition to the technical features of the above-mentioned embodiments, this embodiment also comprises the following technical features.

The first side plate 130 and the second side plate 140 both comprise a first plate body 160, a second plate body 162 and a third plate body 164. The first plate body 160 is provided at one end of the first side plate 130 or one end of the second side plate 140 in a length direction, the second plate body 162 is disposed with the first plate body 160 side by side; and the third plate body 164 is provided at the other end of the first side plate 130 or the other end of the second side plate 140 in a length direction, wherein thicknesses of the first plate body 160 and the third plate body 164 are respectively greater than a thickness of the second plate body 162, the second plate body 162 is respectively connected with the first plate body 160 and the third plate body 164 on opposite sides in a length direction by friction welding, to splice out the first side plate 130 or the second side plate 140.

In this embodiment, since the first side plate 130 and the second side plate 140 comprise the first plate body 160, the second plate body 162 and the third plate body 164, the first plate body 160 is a lug plate structure. The lug structure increases the thickness of the first connecting portion 104, thus, the structural strength of the first connecting portion 104 can be improved.

The first side plate 130 or the second side plate 140 of the boom 100 as the middle hinged end is welded by the first plate body 160, the second plate body 162 and the third plate body 164 by friction stir welding. Since the first plate body 160 is located at the end portion of the first end of the first side plate 130 or the second side plate 140, that is, the first plate body 160 is located at the first connecting portion 104. Therefore, the thickness of the first plate body 160 is greater than that of the second plate body 162, so as to enhance the structural strength and make the first connecting portion 104 play a better connection role. The thickness of the third plate body 164 is greater than that of the second plate body 162, so that the second connecting portion 106 can play a better connection role. The inner surface of the first plate body 160, the inner surface of the second plate body 162 and the inner surface of the third plate body 164 are located in the same plane, that is, the outer surface of the first plate body 160 and the outer surface of the third plate body 164 both protrude from the outer surface of the second plate body 162. It is convenient to install the axle sleeve 150 on the first connecting portion 104 and the second connecting portion 106, which makes the connection between the two adjacent booms 100 more convenient. Friction welding is a method of using the heat generated by the mutual movement and friction of the end surfaces of the work piece to make the end portion reach a thermoplastic state, and then quickly upsetting to complete the welding. Friction stir welding is a kind of friction welding, and friction stir welding also uses friction heat and plastic deformation heat as welding heat sources. The difference between it and ordinary friction welding is that the welding process of friction stir welding is that a stirring needle of a cylinder or other shape (such as a threaded cylinder) is inserted into the joint of the work piece, and the high-speed rotation of the welding head makes it rub against the welding work piece material, so that the temperature of the material at the connecting portion increases and softens. The first plate body 160, the second plate body 162 and the third plate body 164 are connected by friction stir welding, which can ensure the integral structural strength of the first side plate or the second side plate.

The boom 100 also comprises an axle sleeve 150, which is also connected by friction welding with the first side plate 130 and/or the second side plate 140. The axle sleeve 150 is used to install the hinged axle to connect the two adjacent booms 100.

Embodiment 7

Figure 5:
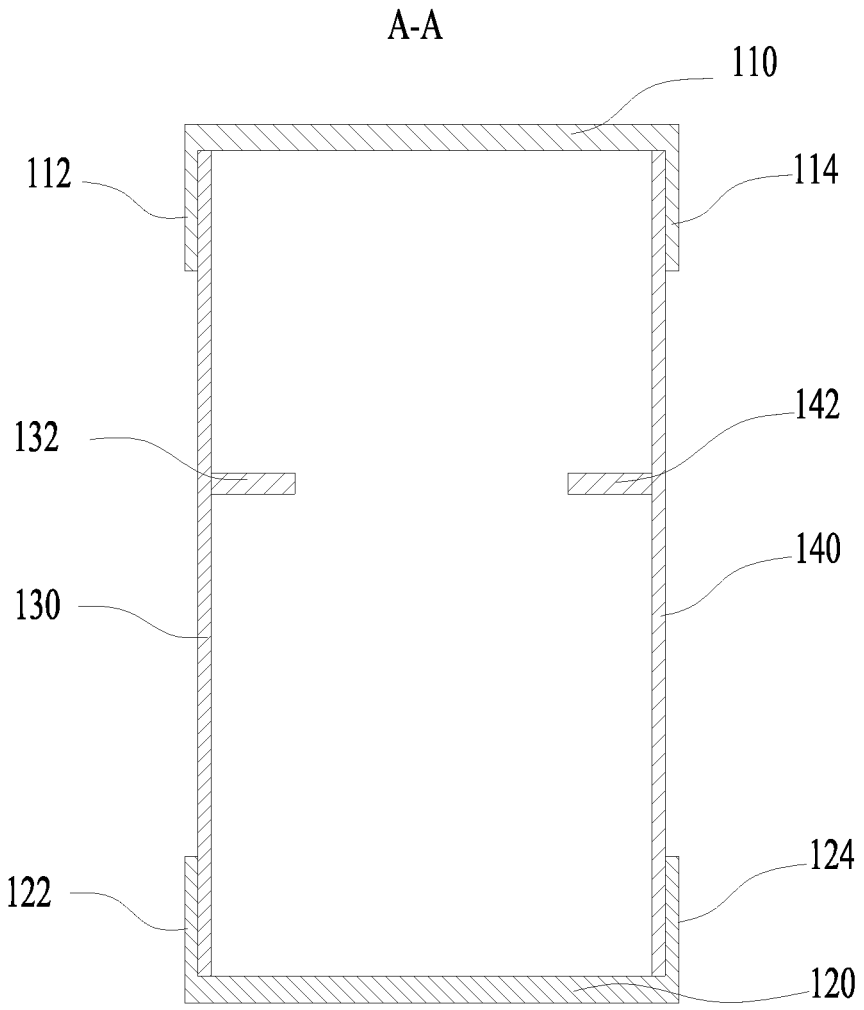
FIG. 5 is a schematic structural diagram of a cross-sectional view along A-A in FIG. 4.

As shown in FIG. 5, this embodiment provides a boom 100. In addition to the technical features of the above-mentioned embodiments, this embodiment also comprises the following technical features.

The boom 100 further comprises a first rib plate 132 and a second rib plate 142. The first rib plate 132 is provided on a surface of the first side plate 130 facing the second side plate 140, and the first rib plate 132 is located between the first bending portion 112 and the third bending portion 122; and the second rib plate 142 is provided on a surface of the second side plate 140 facing the first side plate 130, and the second rib plate 142 is located between the second bending portion 114 and the fourth bending portion 124.

In this embodiment, the first rib plate 132 is arranged along the length direction of the first side plate 130, and the second rib plate 142 is arranged along the length direction of the second side plate 140, so as to be able to increase the structural strength of the first side plate 130 and the second side plate 140, respectively.

Embodiment 8

Figure 6:
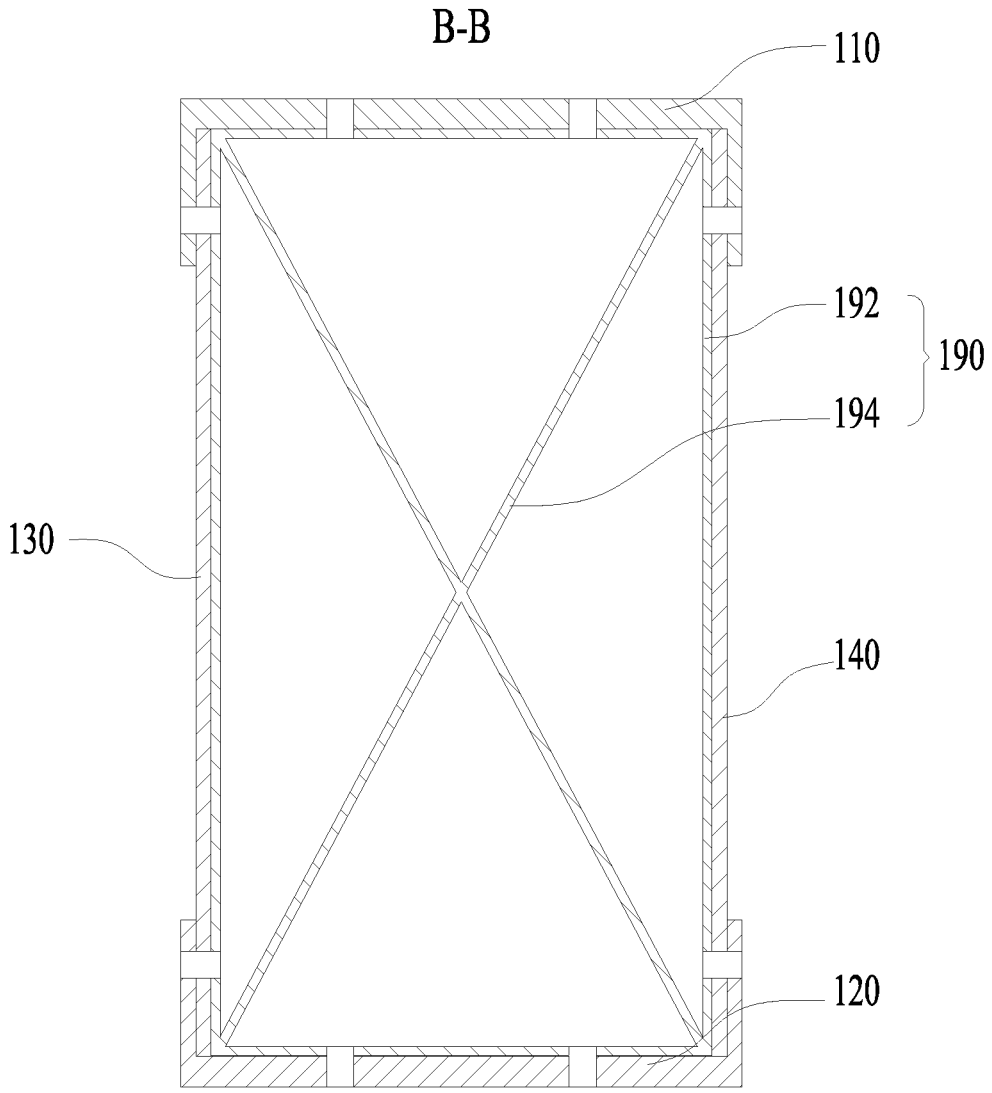
FIG. 6 is a schematic structural diagram of a cross-sectional view along B-B in FIG. 4.

As shown in FIG. 6, this embodiment provides a boom 100. In addition to the technical features of the above-mentioned embodiments, this embodiment also comprises the following technical features.

The boom 100 further comprises a support member 190, arranged in the frame structure, wherein the support member 190 comprises a support frame 192, the support frame comprises four edge frames and four inner corners, and the four edge frames are adapted to abut with the top plate 110, the bottom plate 120, the first side plate 130 and the second side plate 140 respectively; and a support bracket 194, comprising two mutually intersecting support plates to be supported on the four inner corners of the support frame 192.

In this embodiment, the support member 190 can be made of steel plate, and one or more support members 190 can be arranged in the frame structure of the boom 100. The support member 190 is supported in the frame structure through the support frame 192, and the support for the frame structure is further increased by the support bracket 194, which can increase the integral structural strength of the boom 100.

Embodiment 9

This embodiment provides a boom 100. In addition to the technical features of the above-mentioned embodiments, this embodiment also comprises the following technical features.

The top plate 110 and the bottom plate 120 are carbon fiber plates respectively, and the first side plate 130 and the second side plate 140 are aluminum alloy plates respectively.

In this embodiment, 7-series aluminum alloys are selected as the top plate 110 and the bottom plate 120, wherein, 7-series aluminum alloys are a common alloy in aluminum alloys, comprising zinc and magnesium. The weight of aluminum alloy is lighter than that of steel plate. Therefore, the boom 100 assembled by splicing carbon fiber plate and aluminum alloy plate not only reduces the weight, but also ensures the compression resistance performance of boom 100. And compared with the boom 100 made of pure carbon fiber material, the cost of raw materials is reduced. The welding of aluminum alloys has not received attention in the engineering field, especially the 7 series aluminum alloys, the present disclosure boldly adopts the friction stir welding process of the 7-series aluminum alloys. In addition, by using the combination of 7-series aluminum alloy and carbon fiber sheet, the cost of the mold for boom 100 is also greatly reduced. At the same time, compared with the carbon fiber boom made as a whole, it also improves the molding efficiency of the boom 100.

Embodiment 10

This embodiment provides a working equipment, which can be a concrete delivery pump truck, a fire truck, a crane, a placing boom, and the like. The working equipment comprises a chassis and a boom system, and the boom system is arranged on the chassis; wherein, the boom system comprises the boom 100 in any one of the embodiments, and two adjacent booms 100 are hinged to each other.

In this embodiment, the boom system is composed of multi-section boom 100, connecting rod, oil cylinder and connecting piece, etc. The boom 100 located at one end of the boom system is connected with the chassis. Thus, the boom system has the beneficial effects of the boom 100 in any one of the embodiments. When the working equipment is working, the boom system is unfolded and extended under the drive of the hydraulic cylinder to transport concrete. During the driving process of the working equipment, the boom system needs to be folded and placed on the vehicle body. Therefore, under the action of the telescopic rod of the oil cylinder, the working equipment has a foldable or telescopic boom system. The working equipment in this embodiment can be a concrete mixer or the like.

To sum up, the beneficial effects of the embodiments of the present disclosure are:

1. By splicing the opposite sides of the top plate 110 and the bottom plate 120 with the first side plate 130 and the second side plate 140, respectively, a boom 100 with a frame structure is defined. As a result, the boom 100 has higher strength, more stable integral structure, and is suitable for mass production. Compared with the integral molding mold, a variety of simple molds are used, and the cost of later design changes is low.

2. By using carbon fiber plates as the top plate 110 and the bottom plate 120, and using aluminum alloy plates or profiles as the first side plate 130 and the second side plate 140, the cost of raw materials and molds is lower than that of pure carbon fiber boom. Compared with steel boom, the weight is reduced by more than 35%, the stress amplitude is reduced by more than 50%, and the rigidity is reduced by less than 10%.

3. The post-maintenance difficulty and cost of the spliced boom 100 are much lower than those of the boom formed by integral molding of carbon fiber composite materials.

In the present disclosure, the terms "first", "second", and "third" are used for the purpose of description only, and cannot be understood as indicating or implying relative importance; and the term "plurality" means two or more, unless otherwise expressly defined. The terms "installing", "connected", "connection", "fixing" and the like should be understood in a broad sense. For example, "connection" may be a fixed connection, a removable connection or an integral connection; and "connected" may refer to direct connection or indirect connection through an intermediary. A person of ordinary skills in the art could understand the specific meaning of the terms in the present disclosure according to specific situations.

In the description of the present disclosure, it should be understood that the orientation or position relationships indicated by the terms "upper", "lower", "left", "right", "front", "back" and the like are the orientation or position relationships based on what is shown in the drawings, are merely for the convenience of describing the present disclosure and simplifying the description, and do not indicate or imply that the device or unit referred to must have a particular direction and is constructed and operated in a specific orientation, and thus cannot be understood as the limitation of the present disclosure.

In the description of the present specification, the descriptions of the terms "one embodiment", "some embodiments" and "specific embodiments" and the like mean that specific features, structures, materials or characteristics described in conjunction with the embodiment(s) or example(s) are comprised in at least one embodiment or example of the present disclosure. In the specification, the schematic representation of the above terms does not necessarily refer to the same embodiment or example. Moreover, the specific features, structures, materials or characteristics described may be combined in a suitable manner in any one or more embodiments or examples.

The descriptions above are only preferred embodiments of the present disclosure, which are not used to limit the present disclosure. For a person skilled in the art, the present disclosure may have various changes and variations. Any modifications, equivalent substitutions, improvements etc. within the spirit and principle of the present disclosure shall all be comprised in the protection scope of the present disclosure.

What is claimed is:

1. A boom comprising a frame structure, wherein the boom comprises:

a top plate;

a bottom plate, wherein the bottom plate and the top plate are oppositely disposed at an interval;

a first side plate; and a second side plate, wherein the second side plate and the first side plate are oppositely disposed at an interval, wherein a first side of the top plate is provided with a first bending portion, at least a portion of the first bending portion and a first end of the first side plate are attached and spliced to each other, a second side of the top plate opposite to the first bending portion is provided with a second bending portion, at least a portion of the second bending portion and a first end of the second side plate are attached and spliced to each other; and a first side of the bottom plate is provided with a third bending portion, at least a portion of the third bending portion and a second end of the first side plate are attached and spliced to each other, a second side of the bottom plate opposite to the third bending portion is provided with a fourth bending portion, at least a portion of the fourth bending portion and a second end of the second side plate are attached and spliced to each other, and define the frame structure;

the top plate and the bottom plate are respectively carbon fiber plates, and the first side plate and the second side plate are respectively aluminum alloy plates;

the top plate and the bottom plate are bonded and mechanically connected with the first side plate and the second side plate.

2. The boom according to claim 1, wherein the first bending portion and the second bending portion are respectively integrally formed with the top plate, and both face the bottom plate, the third bending portion and the fourth bending portion are respectively integrally formed with the bottom plate, and both face the top plate.

3. The boom according to claim 2, further comprising:

a first clamping slot, provided on an end surface of the first bending portion facing the bottom plate;

a second clamping slot, provided on an end surface of the second bending portion facing the bottom plate;

a third clamping slot, provided on an end surface of the third bending portion facing the top plate; and a fourth clamping slot, provided on an end surface of the fourth bending portion facing the top plate, wherein, two opposite ends of the first side plate are respectively clamped with the first clamping slot and the third clamping slot, two opposite ends of the second side plate are respectively clamped with the second clamping slot and the fourth clamping slot.

4. The boom according to claim 3, further comprising:

a middle body;

a first connecting portion, provided at a first end of the middle body in a length direction and protruding out of the middle body; and a second connecting portion, provided at a second end of the middle body in the length direction, wherein a thickness of the middle body gradually decreases from the first connecting portion to the second connecting portion, a thickness of the second connecting portion is equal to a thickness of the second end of the middle body in the length direction.

5. The boom according to claim 3, further comprising:

a first rib plate, provided on a surface of the first side plate facing the second side plate, and the first rib plate being located between the first bending portion and the third bending portion; and a second rib plate, provided on a surface of the second side plate facing the first side plate, and the second rib plate being located between the second bending portion and the fourth bending portion.

6. The boom according to claim 3, further comprising: a support member, arranged in the frame structure, wherein the support member comprises:

a support frame, the support frame comprises four edge frames and four inner corners, and the four edge frames are adapted to abut with the top plate, the bottom plate, the first side plate and the second side plate respectively; and a support bracket, comprising two mutually intersecting support plates to be supported on the four inner corners of the support frame.

7. The boom according to claim 1, wherein the first bending portion and the second bending portion are respectively connected with the first end of the first side plate and the first end of the second side plate in a rivet bonding connection, the third bending portion and the fourth bending portion are respectively connected with the second end of the first side plate and the second end of the second side plate in a rivet bonding connection.

8. The boom according to claim 7, further comprising:

a first clamping slot, provided on an end surface of the first bending portion facing the bottom plate;

a second clamping slot, provided on an end surface of the second bending portion facing the bottom plate;

a third clamping slot, provided on an end surface of the third bending portion facing the top plate; and a fourth clamping slot, provided on an end surface of the fourth bending portion facing the top plate, wherein, two opposite ends of the first side plate are respectively clamped with the first clamping slot and the third clamping slot, two opposite ends of the second side plate are respectively clamped with the second clamping slot and the fourth clamping slot.

9. The boom according to claim 8, further comprising:

a first rib plate, provided on a surface of the first side plate facing the second side plate, and the first rib plate being located between the first bending portion and the third bending portion; and a second rib plate, provided on a surface of the second side plate facing the first side plate, and the second rib plate being located between the second bending portion and the fourth bending portion.

10. The boom according to claim 8, further comprising: a support member, arranged in the frame structure, wherein the support member comprises:

a support frame, the support frame comprises four edge frames and four inner corners, and the four edge frames are adapted to abut with the top plate, the bottom plate, the first side plate and the second side plate respectively; and a support bracket, comprising two mutually intersecting support plates to be supported on the four inner corners of the support frame.

11. The boom according to claim 1, further comprising:

a first clamping slot, provided on an end surface of the first bending portion facing the bottom plate;

a second clamping slot, provided on an end surface of the second bending portion facing the bottom plate;

a third clamping slot, provided on an end surface of the third bending portion facing the top plate; and a fourth clamping slot, provided on an end surface of the fourth bending portion facing the top plate, wherein, two opposite ends of the first side plate are respectively clamped with the first clamping slot and the third clamping slot, two opposite ends of the second side plate are respectively clamped with the second clamping slot and the fourth clamping slot.

12. The boom according to claim 1, further comprising:

a first rib plate, provided on a surface of the first side plate facing the second side plate, and the first rib plate being located between the first bending portion and the third bending portion; and a second rib plate, provided on a surface of the second side plate facing the first side plate, and the second rib plate being located between the second bending portion and the fourth bending portion.

13. The boom according to claim 1, further comprising: a support member, arranged in the frame structure, wherein the support member comprises:

a support frame, the support frame comprises four edge frames and four inner corners, and the four edge frames are adapted to abut with the top plate, the bottom plate, the first side plate and the second side plate respectively; and a support bracket, comprising two mutually intersecting support plates to be supported on the four inner corners of the support frame.

14. A working equipment, comprising:

a chassis; and a boom system, provided on the chassis, wherein the boom system comprises a plurality of booms, and two adjacent booms are hinged to each other;

wherein, each of the plurality of booms comprises a frame structure, and each of the plurality of booms comprises:

a top plate;

a bottom plate, wherein the bottom plate and the top plate are oppositely disposed at an interval;

a first side plate; and a second side plate, wherein the second side plate and the first side plate are oppositely disposed at an interval;

wherein a first side of the top plate is provided with a first bending portion, at least a portion of the first bending portion and a first end of the first side plate are attached and spliced to each other, a second side of the top plate opposite to the first bending portion is provided with a second bending portion, at least a portion of the second bending portion and a first end of the second side plate are attached and spliced to each other; and a first side of the bottom plate is provided with a third bending portion, at least a portion of the third bending portion and a second end of the first side plate are attached and spliced to each other, a second side of the bottom plate opposite to the third bending portion is provided with a fourth bending portion, at least a portion of the fourth bending portion and a second end of the second side plate are attached and spliced to each other, and define the frame structure;

the top plate and the bottom plate are respectively carbon fiber plates, and the first side plate and the second side plate are respectively aluminum alloy plates;

the top plate and the bottom plate are bonded and mechanically connected with the first side plate and the second side plate.

15. The working equipment according to claim 14, wherein the first bending portion and the second bending portion are respectively integrally formed with the top plate, and both face the bottom plate, the third bending portion and the fourth bending portion are respectively integrally formed with the bottom plate, and both face the top plate.

16. The working equipment according to claim 14, wherein the first bending portion and the second bending portion are respectively connected with the first end of the first side plate and the first end of the second side plate in a rivet bonding connection, the third bending portion and the fourth bending portion are respectively connected with the second end of the first side plate and the second end of the second side plate in a rivet bonding connection.

17. The working equipment according to claim 14, wherein, the boom further comprising:

a first clamping slot, provided on an end surface of the first bending portion facing the bottom plate;

a second clamping slot, provided on an end surface of the second bending portion facing the bottom plate;

a third clamping slot, provided on an end surface of the third bending portion facing the top plate; and a fourth clamping slot, provided on an end surface of the fourth bending portion facing the top plate, wherein, two opposite ends of the first side plate are respectively clamped with the first clamping slot and the third clamping slot, two opposite ends of the second side plate are respectively clamped with the second clamping slot and the fourth clamping slot.

* * * * *